United States Patent [19]

Shaw

[11] Patent Number: 4,738,368

[45] **Date of Patent: * Apr. 19, 1988**

[54] ELEVATOR MECHANISM FOR THE CODE READER OF A MAIL SORTING MACHINE

[75] Inventor: Steve Shaw, Olathe, Kans.

[73] Assignee: Bell & Howell Company, Chicago, Ill.

[ * ] Notice: The portion of the term of this patent subsequent to Jan. 19, 2003 has been disclaimed.

[21] Appl. No.: 512,471

[22] Filed: Jul. 11, 1983

[51] Int. Cl.[4] ..... B07C 3/14

[52] U.S. Cl. ..... 209/569; 209/584; 209/900

[58] Field of Search ..... 209/569, 583, 584, 900; 235/454; 250/566; 318/663, 601, 649; 382/64, 65

[56] References Cited

U.S. PATENT DOCUMENTS

| | | | |
|---|---|---|---|
| 2,928,953 | 3/1960 | Bassler | 235/454 X |
| 3,122,689 | 2/1964 | Atkinson | 318/663 |
| 3,297,925 | 1/1967 | Masel | 318/663 |
| 3,697,849 | 10/1972 | Uchida | 318/663 X |
| 3,737,629 | 6/1973 | See | 250/566 |
| 3,886,371 | 5/1975 | Lloyd | 382/65 |
| 3,983,366 | 9/1976 | Gunn | 235/454 X |
| 4,112,343 | 9/1978 | Douglas | 318/663 X |
| 4,464,614 | 8/1984 | Kurakake | 318/663 X |

*Primary Examiner*—Robert B. Reeves
*Assistant Examiner*—Edward M. Wacyra
*Attorney, Agent, or Firm*—Kokjer, Kircher, Bradley, Wharton, Bowman & Johnson

[57] ABSTRACT

An elevator for adjusting the elevation of a code reader of a high speed mail sorting machine. The elevator is powered by a reversible DC electric motor which operates an extensible and retractable linear actuator. The actuator connects with a platform on which the reader is mounted. A control circuit for the motor includes a digital comparitor which compares the desired elevation of the reader with the actual elevation sensed by a potentiometer. A transistorized motor drive circuit controlled by the comparitor applies current to the motor in opposite directions to cause extension or retraction of the actuator, depending upon whether the reader is below or above the desired elevation. Upper and lower limit switches limit the range of movement of the reader.

12 Claims, 3 Drawing Sheets

4.
5.

SENSOR INPUT
202
(5V OUT)
(SENSOR IN)
(GRD OUT)
TP(GND)
206
TP1
+5V
CLOCKING
150 PF
10K
8 BIT A/D CONV.
VAF/2
(+)
(−)
ANA GND
CK/IN
CK/GND
RES
Vcc
D1 D2 D3 D4 D5 D6 D7 D0
WR
INTR
CS
RD
(NC)
204
74LS 684 8 BIT MAG. COMP.
P1 P2 P3 P4 P5 P6 P7 P0
Q1 Q2 Q3 Q4 Q5 Q6 Q7 Q0
P>Q
P=Q
182
74LS 273 8 BIT LATCH
CLR
Vcc
D0 D1 D2 D3 D4 D5 D6 D7
Q0 Q1 Q2 Q3 Q4 Q5 Q6 Q7
CK
GND
190
.01
188
D0 D1 D2 D3 D4 D5 D6 D7 GND GND
1 AMP
172
174
170
+24V
+12V
GND
176
178
3300
OUT IN
GND
180
.01 .47 .1
184
186
208
210
212
214
216
218
220K
220
(P<Q)
222
224
226
2.2K
3.9K
228
230
232
234
148
LOWER LIMIT SW.
238
146
UPPER LIMIT SW.
248
250
242
252
244
246
240
(P>Q)
192
194
196
198
200
236
LOWER
RAISE
124
124a

ELEVATOR MECHANISM FOR THE CODE READER OF A MAIL SORTING MACHINE

BACKGROUND OF THE INVENTION

This invention relates in general to mail sorting equipment and more particularly to an improved elevator for the code reader of a high speed automatic mail sorting machine.

High speed mail sorting machines have recently gained considerable popularity, due in large part to the increasingly large volume of mail that must be handled daily by the postal service, modern businesses, governmental units and other large institutions. An automatic mail sorting machine typically includes a feeder device which receives a stack of envelopes and feeds them to a pick off mechanism which picks the individual envelopes off of the stack and delivers them one at a time past a code reading device. As the envelopes are conveyed past the reader, it reads coded indicia on the envelopes such as zip codes or bar codes. Electronic sorting circuitry then controls deflector gates or other diverter devices which direct the envelopes into separate sorting bins corresponding to the coded indicia. In this manner, all envelopes having the same code are deposited in the same bin or bins of the mail sorting machine.

As previously indicated, sorting information in coded form is imprinted on the envelopes and is read by the code reading device. Zip codes are often used as the coded indicia so that outgoing mail can be sorted into groups of envelopes having a common destination. Alternatively, coded information representing the different departments within a large business or governmental entity can be used to facilitate the routing of incoming mail to the proper department. The coded information is usually in the form of a magnetic code or a bar code. Magnetic reading devices are used to read the magnetic code, while optical code readers are normally used to read the bar code.

In either case, it is desirable to provide for adjustment of the elevation of the reader in order to compensate for the differences in the location of the coded indicia. For example, if the machine handles envelopes that differ in size, the zip code or bar code information can be at a different elevation for each different sized envelope. Even envelopes having the same size sometimes have the code imprinted at different elevations for different batches of mail. Accordingly, the reader device must be capable of being moved up and down in order to properly align with coded indicia at various elevations. The range of movement should be great enough to accommodate the widest difference in position of the codes, which may vary by up to about three inches.

In the past, elevators have been devised to permit adjustment of the elevation of the reader. However, the known elevator devices have performed in a less than satisfactory manner in a number of respects. Perhaps most notably, the slow speed at which existing elevators operate has been a problem. The code reader is mounted on a plate or platform which is moved up or down by screw drives connected with the corners of the platform. An electric motor drives the screws through a chain and sprocket drive system. With this type of arrangement, the code reader head is moved up and down so slowly that it can take up to five minutes for the reader to be moved between extreme positions. As can easily be appreciated, this causes significant delays in the adjustment of the code reader and slows down the mail sorting operation accordingly.

Another problem with existing elevator devices is that human error can cause misalignment of the reader unit. Typically, the operator of the machine must operate a manual switch which activates the motor and causes the reader to be moved until it is perceived as being at the proper height, as indicated by visual alignment of a pointer or other indicator with the coded information on the envelopes that are to be handled. The switch is then released and the motor stops. This procedure is not only cumbersome and time consuming, but it also often leads to errors in alignment due to the parallax that is involved in attempting to visually align the pointer with the code on the envelopes.

SUMMARY OF THE INVENTION

In view of the many problems and drawbacks associated with the elevator devices that have in the past been used with the code reader of a mail sorting machine, it is apparent that a need exist for an improved elevator for adjusting the elevation of a code reader quickly and accurately while minimizing the opportunity for operator error. It is the principal goal of the present invention to meet that need.

More specifically, it is the primary object of the invention to provide, in a high speed automatic mail sorting machine, an elevator mechanism and control system for accurately positioning a code reader in proper alignment with the coded indicia on envelopes that are to be sorted. In accordance with the invention, the code reader is mounted on a platform which is in turn mounted for up and down movement on a pair of upright guide posts. The elevation of the platform is controlled by a single extensible and retractable actuator which connects near the center of the platform and is driven by a DC electric motor. Mounting the platform in this manner and connecting the actuator with the platform at a location between the guide posts simplifies and improves the construction of the elevator in comparison with the multiple screw, chain and sprocket system that has been used in the past. Also, the speed of the elevator is greatly improved. The reader head can be moved through its entire range of travel in about 24 seconds rather than five minutes as required in prior units.

The unique control system of the present invention automatically and accurately positions the reader head and avoids the human error associated with the visual alignment procedure that has been required in the past. The actual elevation of the reader is sensed and compared with the desired elevation that is required to align the reader with the code imprinted on the envelopes. Information as to the desired elevation of the reader is entered on a keyboard. If the platform is below the desired position, the control system drives the electric motor in a direction to extend the actuator, thereby raising the platform until the reader unit reaches the desired position. If the reader is above the desired elevation, the current to the motor is reversed and the platform is then lowered until the desired position is reached. Once the platform has been moved up or down to the desired elevation aligning the reader with the coded indicia on the envelopes, the motor is deenergized and the actuator maintains the platform at the proper position to read the codes. To handle a different batch of envelopes having their code at a different elevation, the new code elevation is entered on the keyboard and the reader is automatically moved to the proper elevation to align with the code.

DETAILED DESCRIPTION OF THE INVENTION

In the accompanying drawings which form a part of the specification and are to be read in conjunction therewith and in which like reference numerals are used to indicate like parts in the various views.

Figures 1, 2:
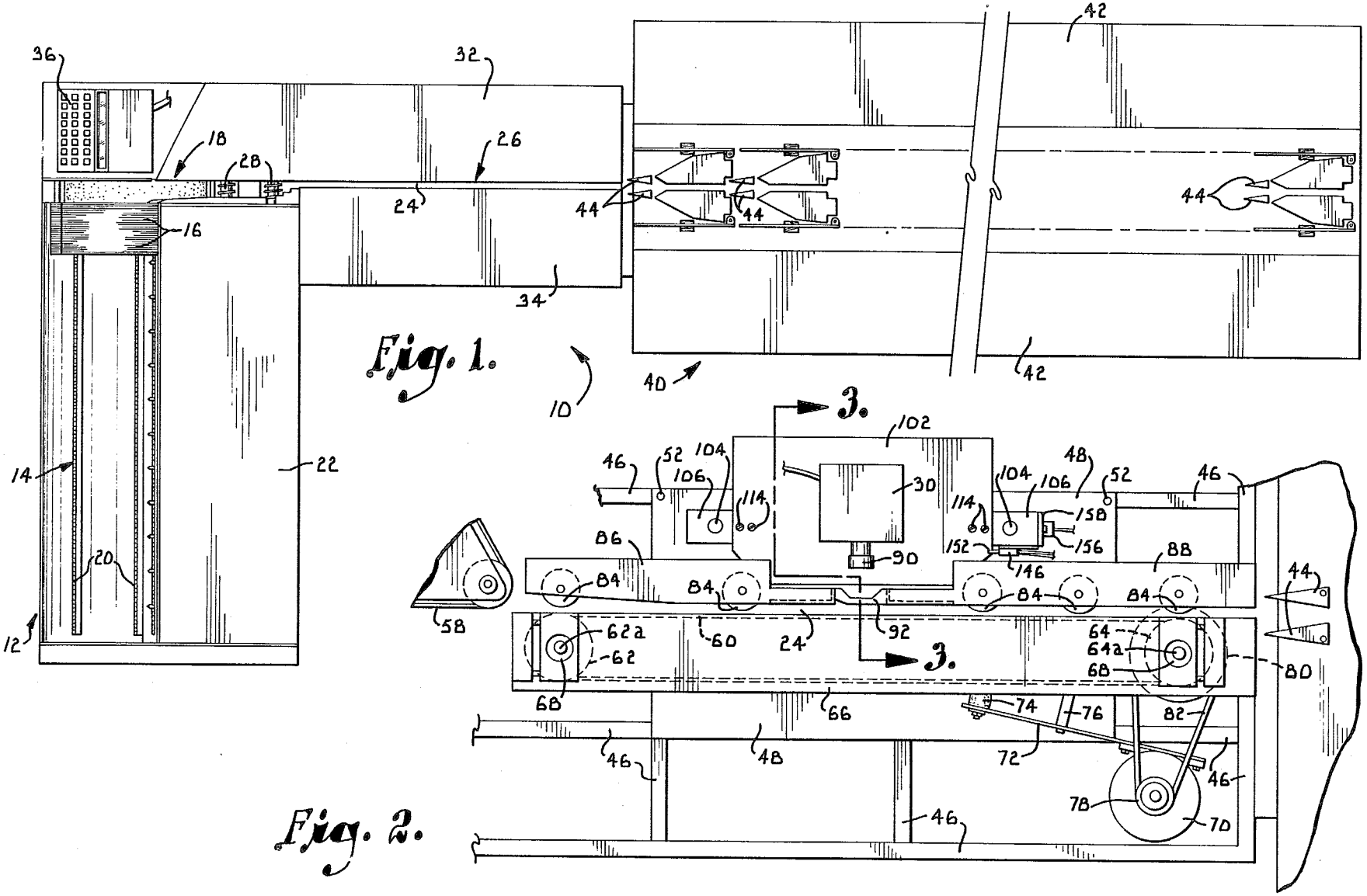
FIG. 1 is a top plan view of an automatic mail sorting machine equipped with an optical code reader and elevator mechanism constructed according to a preferred embodiment of the present invention, with the break lines indicating continuous length of the bin section of the machine.
FIG. 2 is a fragmentary plan view on an enlarged scale showing the code reader and associated components of the machine, with the covers removed to reveal the interior components.

Referring now to the drawings in more detail and initially to FIG. 1, numeral 10 generally designates a high speed automatic mail sorting machine. The machine 10 is constructed in the same general manner as the machine disclosed in U.S. Pat. No. 4,275,875 which issued on June 30, 1981 to Roy Akers.

The machine 10 generally includes a magazine section 12 having a feeder device 14 which receives a stack of envelopes 16 and feeds them to a pick off station 18. The feeder 14 includes a pair of chains 20 which are driven in any suitable manner to feed the stack of envelopes to the pick off station 18. A horizontal table 22 is located to one side of the feeder 14.

At the pick off station 18, the envelopes 16 are picked off of the stack and delivered one at a time into a thin guideway 24 located adjacent to a read station 26 at which coded indicia on the envelopes are read. Grooved rollers 28 may be used to deliver the envelopes one at a time into the guideway 24. The envelopes are maintained in a vertical orientation on their lower edges, and the front surface of each envelope faces the read station.

Figures 3, 4, 5:
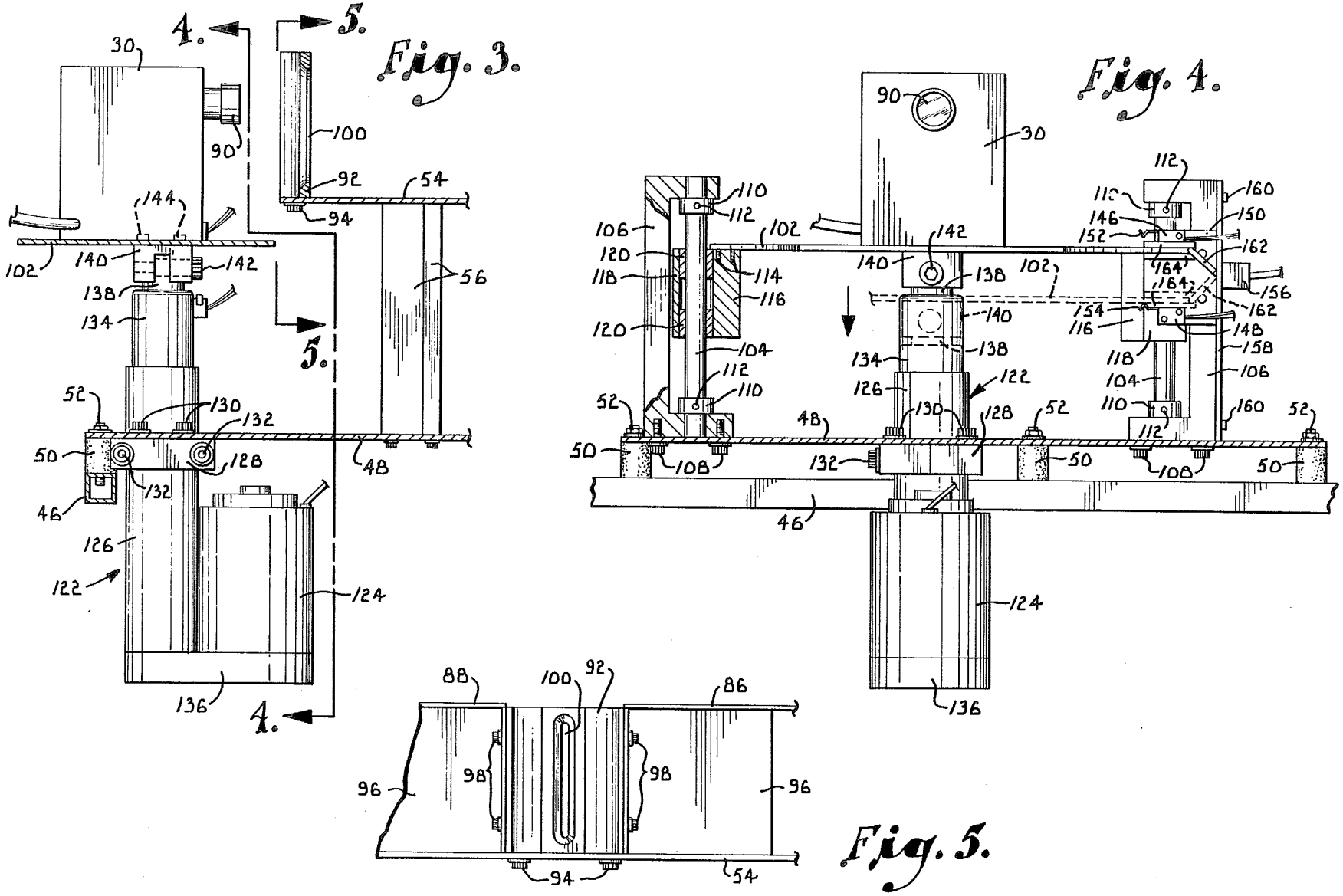
FIG. 3 is a fragmentary sectional view on an enlarged scale taken generally along line 3—3 of FIG. 2 in the direction of the arrows.
FIG. 4 is a fragmentary sectional view taken generally along line 4—4 of FIG. 3 in the direction of the arrows, with portions broken away for purposes of illustration and the dashed line view showing the elevator at its lower limit of travel.
FIG. 5 is a fragmentary view taken generally along line 5—5 of FIG. 3 in the direction of the arrows.

At the read station 26, a code imprinted on each envelope is read by a code reader 30 (see FIGS. 2–4). Covers 32 and 34 cover the code reader 30 and the components located on the opposite side of the guideway 24. A keyboard 36 is provided adjacent an operator's station located at the end of the magazine section of the machine.

After the codes on the envelopes have been read, the envelopes are conveyed one at a time through the guideway 24 and into a bin section 40 of the mail sorting machine. Arrays of sorting bins indicated generally by numeral 42 are located on opposite sides of the bin section of the machine and receive the sorted envelopes. The envelopes are passed between the two sets of bins and are directed into the appropriate bins by sets of diverter gates 44 which deflect each envelope into the proper bin in accordance with the coded indicia on the envelope read by the code reader 30.

The present invention is directed to an elevator mechanism for the code reader 30 and to a control system for the elevator mechanism. The code reader 30 can be of any suitable type such as a magnetic reader which reads magnetically coded indicia on the envelopes or an optical code reader which optically reads bar codes imprinted on the envelopes. In a preferred form of the invention, the code reader 30 is an optical code reader.

Referring now more particularly to FIGS. 2–4, the frame of the mail sorting machine 10 is formed by a plurality of square tubes 46 which are rigidly interconnected. A horizontal plate 48 is secured to the frame members 46. As best shown in FIGS. 3 and 4, the mounting arrangement for the plate includes a plurality of shock absorbing elements 50 which are interposed between plate 48 and the frame members 46 and secured by suitable fastening elements 52.

A smaller horizontal plate 54 (FIG. 3) underlies the guideway 24 to provide a support surface on which the lower edges of the envelopes rest as they are conveyed through the guideway and past the code reader 30. Plate 54 is supported above plate 48 on top of a plurality of upright support posts 56 secured to plate 48 at their lower ends and to plate 54 at their top ends.

With particular reference to FIG. 2, the envelopes which are picked off at the pick off station of the machine are delivered one at a time into guideway 24 by a belt conveyor 58. The envelopes are conveyed through the guideway by another belt conveyor formed by a pair of belts 60 each drawn around a pair of pulleys 62 and 64. The pulleys are mounted on vertical shafts 62*a* and 64*a* which extend between plate 54 and a top plate 66 supported above plate 54. Bearings 68 receive the shafts for the pulleys 62 and 64. The edge of the top plate 66 forms one side of the guideway 24, and the conveyor belts 60 run along the length of the guideway beneath the edge of plate 66 in order to convey the envelopes through the guideway and past the code reader 30 to the bin section of the machine.

Pulleys 64 are driven by an electric motor 70 which is mounted on a vertical bracket plate 72. The bracket plate 72 is in turn mounted on the main support plate 48 by means of a shock absorber mount 74 and a pivoted post 76. Motor 70 drives a pulley 78 which drives a larger pulley 80 through a drive belt 82. Pulley 80 is located on the underside of plate 54 and is secured to shaft 64*a* in order to drive pulley 64 and belt 60 when motor 70 is active.

The side of each envelope opposite the conveyor belts 60 is engaged by a series of idler pulleys 84 which are mounted between plate 54 and upper guide plates 86 and 88 spaced above plate 54. The edges of the upstream and downstream guide plates 86 and 88 form one side of the guideway 24, and the idler pulleys 84 project slightly into the guideway in order to assist the conveyor belts 60 in conveying the envelopes.

Referring now particularly to FIGS. 3 and 5, the optical code reader 30 has a lens 90 which is aligned with a window 92 mounted on plate 54 at a location between the upstream and downstream guide plates 86 and 88. As best shown in FIG. 5, the bottom of the window 92 is secured to plate 54 by a pair of screws 94. A pair of light shields 96 are located on opposite sides of the window 92 and have flanges which are secured to the opposite sides of the window by screws 98. The window 92 has a vertical slot 100 which is aligned with the lens 90 of the optical code reader 30 so that light from the reader can be focused on the bar codes imprinted on the envelopes.

In accordance with the present invention, the code reader 30 is mounted on top of a horizontal platform 102 formed by a metal plate. As shown in FIG. 4, the platform 102 is in turn supported for up and down movement on a pair of vertical shafts or posts 104. The posts 104 are received in the upper and lower legs of C-shaped brackets 106 having their lower legs secured by screws 108 to the main support plate 48. Each post 104 is provided with a pair of collars 110 located adjacent to the upper and lower legs of bracket 106 and secured to the post by set screws 112.

With continued reference to FIG. 4, the opposite sides of platform 102 are secured by screws 114 to flanges 116 projecting from sleeve 118. Each sleeve 118 carries a pair of linear bearings 120 which are fitted on the corresponding post 104. In this manner, the platform 102 is supported for up and down movement on posts 104, and the mounting arrangement maintains the platform in a horizontal orientation at all times.

The platform is driven up and down by a linear actuator 122 powered by a reversible DC electric motor 124. As shown in FIGS. 3 and 4, the actuator 122 includes an outer tube 126 which receives a clamp 128 secured to the underside of the main plate 48 by a plurality of screws 130. The clamp 128 is tightened on tube 126 by tightening a pair of screws 132. In this manner, the actuator assembly is mounted to the main plate 48. Tube 126 extends through an opening formed in plate 48.

The actuator 122 is an extensible and retractable linear actuator having a conventional construction. An inside tube 134 fits inside of the outer tube 126 and is extensible out of and retractable into the outer tube. The inside tube 134 has a threaded connection with the outside tube 126 and can thus be screwed out of and into the outer tube by the electric motor 124. The motor 124 turns the inside tube 134 in opposite directions through a reduction gear assembly 136. Since motor 124 is a reversible DC motor, reversing the current to the motor causes a reversal in the direction of movement of the actuator.

The inside tube 134 of the linear actuator 122 receives a shaft 138 which is secured to a clevis block 140 by a screw 142. The clevis block 140 is secured to the bottom of platform 102 by a plurality of screws 144. It is thus apparent that extension of the actuator 122 raises platform 102 and the code reader 30, while retraction of the actuator lowers the platform and reader. The clevis block 140 connects with platform 102 at a substantially central location on the platform midway between the two guide posts 104.

The travel of the platform 102 is limited by upper and lower limit switches 146 and 148 (FIG. 4). Both limit switches are mounted on a bracket plate 150 which is secured to one of the post brackets 106. The limit switches 146 and 148 have projecting actuators 152 and 154 which are engaged by one side edge of the platform 102 when the platform has reached its upper limit and lower limit respectively. The limit switches are normally closed but are open when the corresponding actuator 152 or 154 is contacted by the platform 102. The limit switches 146 and 148 are incorporated into the control circuitry for the elevator mechanism, as will be described more fully.

With continued reference to FIG. 4, a sensor which senses the actual elevation of the platform 102 includes a potentiometer 156 secured to a mounting plate 158. The mounting plate 158 is connected by screws 160 to one of the post brackets 106. The potentiometer 156 has a projecting tab 162 which extends through plate 158 and is received at its free end between a pair of fingers 164 secured to the adjacent side edge of platform 102. As the platform 102 is moved up and down between the solid and broken line positions of FIG. 4, the potentiometer tab 162 is pivoted up and down by the fingers 164 to change the potentiometer resistance in direct proportion to the movement of the platform. The output voltage signal from potentiometer 156 changes in direct proportion to the resistance change and thus provides a signal that is a measure of the actual elevation of the platform 102.

Figure 6:
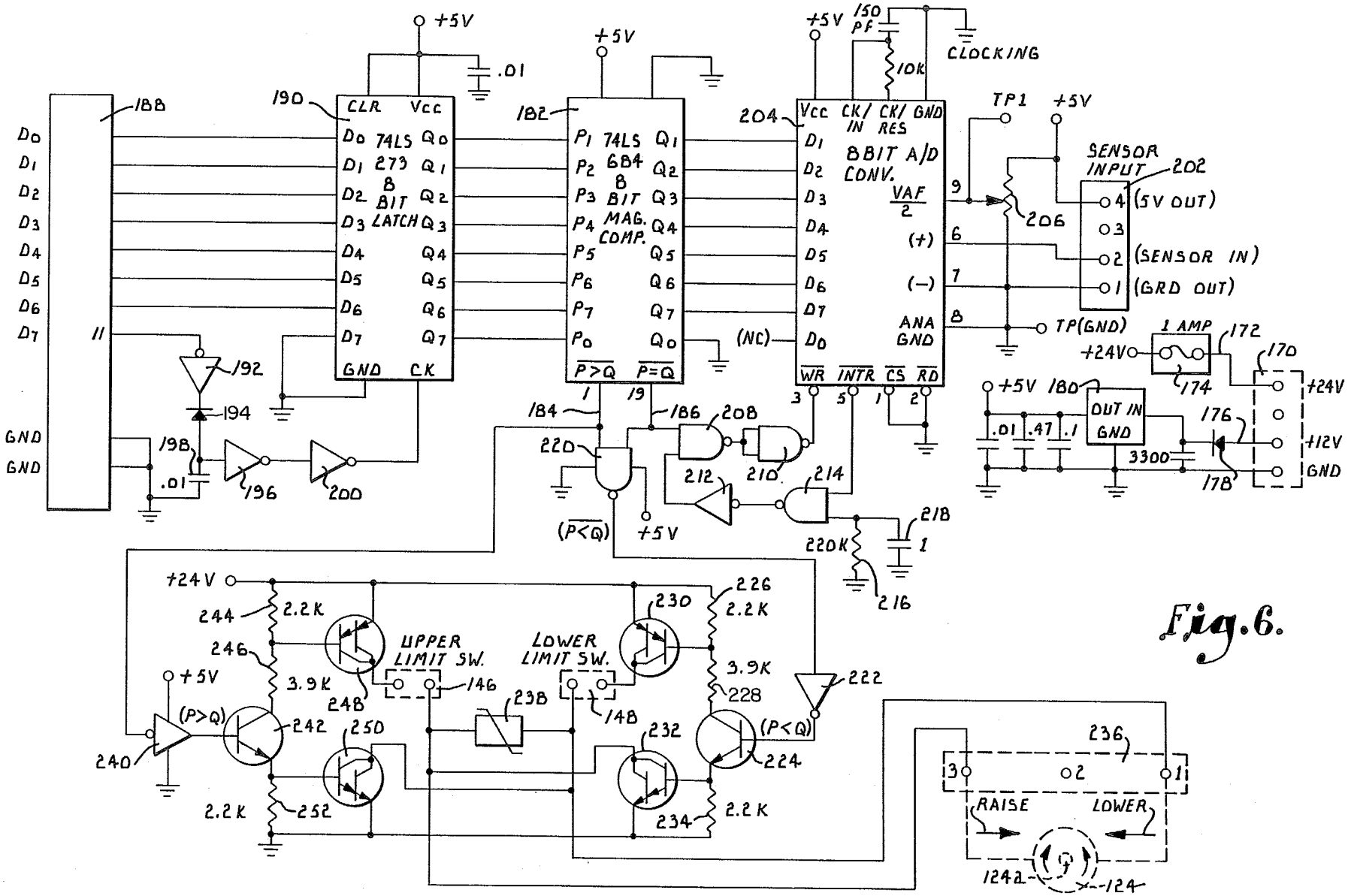
FIG. 6 is a schematic circuit diagram of the control system for the elevator mechanism.

FIG. 6 shows schematically the electronic control system for the elevator mechanism. A power input connector 170 has an unregulated +24 volt line 172 equipped with a one amp fuse 174. A +12 volt line 176 is provided with a diode 178 which connects with the input of a voltage regulator 180. The output side of the voltage regulator 180 provides +5 volts.

The control circuitry includes an eight bit digital magnitude comparitor 182 which receives on its left or P side data representing the desired elevation of the code reader and on its right or Q side data representing the actual elevation of the reader. The comparitor 182 compares the two sets of data and has a pair of active low output lines 184 and 186. Line 184 is in a high state unless the digital data on its P side is greater than the digital data on its Q side, in which case line 184 is in a low state. The other output line 186 is in a high state unless the P data is equal to the Q data, in which case line 186 is in the low state.

The desired elevation of the code reader 30 is entered on the keyboard 36 (FIG. 1) and provided as digital data to a connector 188. Seven of the output pins of the connector 188 connect with the data input pins of an eight bit latch circuit 190. The output pins of latch 190 connect with the P side of the comparitor 182 to provide the comparitor with digital data representing the desired elevation of the optical code reader 30.

The eighth output pin of connector 188 (pin 11) connects with an inverter 192 having its output side connected with a diode 194. The diode is reversed biased when inverter 192 provides a high output. The opposite or anode side of the diode 194 connects with the input of another inverter 196. A capacitor 198 is connected between the input of inverter 196 and system ground. The output side of inverter 196 connects with another inverter 200 having its output side connected with the clock input of the eight bit latch circuit 190.

The actual elevation of the optical code reader is provided as a "sensor in" voltage signal from the position sensing potentiometer 156. The signal from the potentiometer is provided to pin 2 of a sensor input connector 202 and from the connector to an eight bit analog to digital converter 204. The A/D converter converts the analog voltage signal from the potentiometer into digital data which is applied to the Q side of comparitor 182 on the output data lines of the A/D converter 204.

Input pin nine of the A/D converter is connected with 5 volts through a potentiometer 206. By properly adjusting the setting of the potentiometer 206, the full range output from the A/D converter can be obtained for the particular range of travel that is permitted for the optical code reader. For example, if the platform 102 has a range of travel of three inches and the potentiometer 156 is a six inch potentiometer, the voltage input at pin nine of the A/D converter can be adjusted to 2.5 volts by properly setting the potentiometer 206, and the full range output can thus be obtained.

Output line 186 of the comparitor 182 is connected with one input of a NAND gate 208 having its output applied to another NAND gate 210 used as an inverter. The output line from gate 210 is connected with the A/D converter 204 at the $\overline{\text{write}}$ pin 3. The other input to gate 208 comes from an inverter 212 which receives its input from a NAND gate 214. One input of gate 214 is connected with the $\overline{\text{interrupt}}$ pin 5 of the A/D converter 204. The other input of gate 214 is connected with system ground through a resistor 216 and a capacitor 218 arranged in parallel with one another.

The output lines 184 and 186 of comparitor 182 form the two inputs to a NAND gate 220 which applies its output signal to an inverter 222. The output side of inverter 222 is connected with the base of a transistor 224. The collector of transistor 224 is connected with +24 volts through a pair of resistors 226 and 228 and with the base of another transistor 230 through resistor 228. The emitter of transistor 224 connects with the base of another transistor 232 and, through resistor 234, with system ground.

Transistor 230 is connected on its emitter side with +24 volts and on its collector side with the lower limit switch 148 which is in turn connected with pin 1 of a connector 236. Transistor 232 is connected on its emitter side with system ground and on its collector side with pin 3 of connector 236. The drive motor 124 of the linear actuator 122 is connected between pins 1 and 3 of connector 236. When electric current is applied to motor 124 in a direction from pin 1 to pin 3 of connector 236, the motor drives its output shaft **124*a* in a direction to retract actuator 122, thus lowering the optical code reader. Conversely, when current is applied to the motor from pin 3 to pin 1 of connector 236, the shaft 124*a* of the reversible DC motor is driven in a direction to extend actuator 122 to raise the optical code reader. A varistor 238 is connected in parallel with motor 124** for protection of the motor.

Output line 184 of comparitor 182 connects with an inverter 240 having its output side connected with the base of a transistor 242. The collector of transistor 242 is connected through resistors 244 and 246 with +24 volts and through resistor 246 with the base of another transistor 248. The emitter of transistor 248 is connected with +24 volts, and its collector is connected through the upper limit switch 146 with pin 3 of connector 236.

The emitter of transistor 242 is connected with the base of another transistor 250 and, through resistor 252, with system ground. The collector side of transistor 250 is connected with pin 1 of connector 236, and its emitter side is connected with system ground.

In operation, the elevator mechanism positions the lens 90 of the optical code reader 30 at the proper height to align with the bar code or other code imprinted on the envelopes 16 that are to be sorted. The elevation of the coded indicia on the envelopes that are to be sorted is entered on the keyboard 36 and represents the desired elevation of the optical reader which will align its lens 90 with the coded indicia. The desired elevation data are delivered to connector 188 and to the data input lines of the latch circuit 190. The latch is clocked by the D7 data line of connector 188. When the D7 data line is high, a high signal is applied to inverter 192 and its low output state causes capacitor 198 to discharge through diode 194. When a low signal is applied to the D7 line of connector 188, a low signal is applied to inverter 192, and the high output from the inverter reverse biases diode 194. Capacitor 198 is then charged from the input of inverter 196 and, when the capacitor is adequately charged, inverter 196 has a high input and a low output. Inverter 200 then provides a high signal to the clock pin of latch 190, and the data which is present on its input data lines D0–D6 is transferred to the Q0–Q6 output lines and applied to the P side of comparitor 182 as digital data representative of the desired elevation of the code reader.

The capacitor 198 and diode 194 cooperate with the inverters to provide a time delay which assures that the input data is present on the D0–D6 data input lines of latch 190 before the latch is clocked.

The voltage signal applied from potentiometer 156 to the sensor input connector 202 represents the actual elevation of the code reader 30 and is applied to pin 6 of the A/D converter 204. When power is initially applied, the A/D converter requires a low pulse at the $\overline{\text{write}}$ pin 3 in order to operate. This low pulse is assured by the start up circuit.

When the power is off, capacitor 218 is completely discharged through resistor 216, and gate 214 has at least one low input. Thus, when power is initially applied to the circuitry, gate 214 necessarily provides a high output which is applied to inverter 212 and from there as a low input to gate 208. Gate 208 then has a high output which is inverted by gate 210 and applied as a low pulse to the $\overline{\text{write}}$ pin 3, as required to start the A/D converter 204.

After the power has been applied, the capacitor 218 begins to charge from the input of gate 214 and is eventually fully charged to maintain a high signal on one input to gate 214. Since the other input to gate 214 is high in the absence of an interrupt pulse, gate 214 then provides a low output which is inverted and applied as a high input to gate 208. Unless the desired position of the code reader is identical to its actual position, line 186 is high, and gate 208 then provides a low output which is applied as a high input to the $\overline{\text{write}}$ pin 3 of the A/D converter. In this manner, the interrupt function of the A/D converter controls the state of the $\overline{\text{write}}$ pin 3. The interrupt function has no effect if the actual position of the reader conforms with the desired position because line 186 will then be low and gate 208 will provide a high output regardless of the state of the interrupt pin of the A/D converter.

The A/D converter 204 converts the analog voltage signal applied from pin 2 of the sensor input connector 202 into digital data which is delivered to the Q side of the digital comparitor 182. The comparitor then compares the data on the P side (desired elevation) with the data on the Q side (actual elevation) and provides a control signal representative of the comparison.

If the actual elevation of the reader is below the desired elevation, P is greater than Q. Then, line 184 is low and line 186 is high so that gate 220 provides a high output signal which is applied as a low signal to the base of transistor 224. Transistor 224 is non-conductive and maintains transistors 230 and 232 in the non-conductive state.

However, the low state of line 184 results in the application of a high signal to the base of transistor 242, thus making the transistor conductive. Transistors 248 and 250 are in turn made conductive, and a circuit is completed from the 24 volt line through transistor 248, the upper limit switch 146, pin 3 of connector 236, the drive motor 124, pin 1 of connector 236 and transistor 250 to system ground. Motor 124 is then activated and turns its output shaft 124*a* in a direction to extend the linear actuator 122, thus raising platform 102 and the code reader 30.

So long as the actual position remains below the desired position, the linear actuator 122 continues to raise the code reader. When the reader has been raised far enough to reach the desired position, P is equal to Q and the comparitor 182 places line 184 in a high state and line 186 in a low state. Again, gate 220 has a high output signal (due to the low input on line 186) and transistor 224 remains non-conductive. The high signal on line 184 is inverted and applied to the base of transistor 242 as a low signal. Transistors 242, 248 and 250 are then non-conductive, and the circuit to the drive motor 124 is interrupted to deactivate the motor. Line 186 being low also forces the output of gate 208 high which prevents conversion oscillations from the A/D converter $\overline{\text{INTR}}$ output from reaching the $\overline{\text{WR}}$ input, thus stopping the free-running analog to digital conversion process and making the elevator totally non-responsive to extraneous machine vibration. The optical code reader 30 is then at the proper elevation to align its lens 90 with the bar codes that are imprinted on the envelopes 16. The slot 100 in window 92 permits the code reader to read the coded indicia imprinted on the envelopes. The mail sorting machine then operates in the normal fashion to sort the envelopes.

If the machine is to sort a new batch of envelopes having coded indicia at a different elevation, the elevation of the new code is entered on the keyboard 36, and the code reader 30 is automatically raised or lowered until its lens 90 is at the same elevation as the coded indicia.

If the actual elevation of the reader 30 is above the desired elevation, the data applied to the P side of comparitor 182 represent a number less than the number applied to the Q side of the comparitor. P is then less than Q, and both output lines 184 and 186 of the comparitor are in a high state. Transistor 242 remains off. However, transistor 224 is made conductive because the two high inputs to gate 220 causes its output to go low such that inverter 228 provides a high signal to the base of transistor 224. Transistors 230 and 232 are also conductive in this condition, and a circuit is completed through transistor 230, the lower limit switch 148, the drive motor 124, and transistor 232. Since current is applied to motor 124 from pin 1 to pin 3 of connector 236, motor 124 drives its output shaft 124*a* in a direction to retract the linear actuator 122, thereby lowering platform 102 and the optical code reader 30.

The actuator continues to retract until the reader is lowered to the desired elevation, at which time P is equal to Q. As indicated previously, this condition interrupts all circuits to motor 124 and thus deactivates the motor. The actuator then maintains the reader at the desired elevation to properly read the codes imprinted on the envelopes.

The upper and lower limit switches 146 and 148 maintain the platform and code reader within a prescribed range of travel between upper and lower limits. When the upper limit is reached, the edge of platform 102 engages switch actuator 152, thereby opening the upper limit switch 146. This interrupts the circuit between transistor 248 and motor 124 and prevents current from being applied to motor 124 in a direction causing the platform to be raised. The platform can be lowered since the circuit which causes motor 124 to lower the platform does not include the upper limit switch 146.

The lower limit switch 148 functions in a similar manner. When the lower limit of travel is reached, the platform 102 engages the lower switch actuator 154 (FIG. 4) and opens the lower limit switch 148. Further lowering of the platform is precluded because the lower limit switch maintains the circuit open between transistor 230 and motor 124. As a consequence, current cannot be applied to the motor 124 in a direction causing it to lower the platform. The platform can be raised because the lower limit switch is not included in the circuit which acts to extend the actuator.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. In a mail sorting machine having a frame, a reader for reading indicia on envelopes to be sorted, means for conveying the envelopes past the reader, and means for sorting the envelopes in accordance with the indicia thereon, the improvement comprising:

a platform on which the reader is rigidly mounted;

means for mounting said platform in a substantially horizintal orientation on the frame for up and down movement to adjust the elevation of the reader, said mounting means restricting the platform to only up and down movement;

power means for raising the platform in a first mode of operation and lowering the platform in a second mode of operation;

means for receiving coded input data representative of the desired elevation of the reader;

means for sensing the actual postion of the reader and providing a coded signal representative of said actual position, said sensing means being independent of said power means;

means for comparing said coded input data with said coded signal to compare the actual elevation of the reader with the desired elevation thereof, said comparing means providing a control signal indicative of the comparision between the actual and desired elevation of the reader; and control means responsive to said control signal for effecting the first mode of said power means when the control signal indicates that the actual elevation is below the desired elevation and the second mode of said power means when the control signal indicates that the actual elevation is above the desired elevation, said control means deactivating said power means when the control signal indicates that the actual elevation conforms with the desired elevation.

2. The improvement of claim 1, including:

means for establishing upper and lower limits of travel of said platform;

upper limit switch means for deactivating said power means when the platform has reached its upper limit of travel; and lower limit switch means for deactivating said power means when the platform has reached its upper limit of travel.

3. The improvement of claim 1, wherein said power means includes:

a reversible DC electric motor having an output shaft turned in a first direction when electric current is applied to the motor in a first direction and in a second direction when current is applied to the motor in a second direction; and means for connecting said shaft with said platform in a manner to raise the platform when the shaft is turned in the first direction and to lower the platform when the shaft is turned in the second direction, said control means being operable to apply current to said motor in said first direction in the first mode and in said second direction in the second mode.

4. The improvement of claim 3, wherein said control means includes:

a first eletric circuit including said motor and applying current thereto in said first direction when completed;

a second electric circuit including said motor and applying curernt thereto in said second direction when completed;

means for completing said first circuit and interrupting said second circuit when the control signal indicates that the actual elevation is below the desired elevation; and means for completing said second circuit and interrupting said first circuit when the control signal indicates that the actual elevation is above the desired elevation.

5. The improvement of claim 4, wherein said control means includes means for interrupting both of said first and second circuits to deactivate the motor when the control signal indicates that the actual elevation conforms with the desired elevation.

6. The improvement of claim 4, wherein:

said first circuit includes upper limit switch means for interrupting said first circuit at a predetermined upper limit of travel of the platform; and said second circuit includes lower limit switch means for interrupting said second circuit at a predetermined lower limit of travel of the platform.

7. An elevator mechanism for a code reader included in a mail sorting machine to read coded indicia on envelopes for sorting of the envelopes, said elevator mechanism comprising:

a generally planar platform on which the code reader is mounted;

a pair of upright guide posts for the platform mounted on the mail sorting machine at locations parallel to and offset from one another, each post having a vertical orientation;

means for mounting said platform on said guide posts for up and down movement thereon with the platform oriented horizontally;

an extensible and retractable actuator mounted on the mail sorting machine and having one end connected with said platform at a location substantially midway between the guide posts to raise and lower the platform and code reader when the actuator is extended and retracted, respectively, said actuator being extensible and retractable generally parallel to said guide posts;

power means for controlling said actuator, said power means having a first mode of operation for extending the actuator and a second mode of operation for retracting the actuator; and control means for effecting the first and second modes of said power means to raise and lower the platform and code reader and for deactivating said power means to maintain the platform and code reader stationary.

8. An elevator mechanism as set forth in claim 7, including:

means for receiving the desired elevation of the code reader;

means for sensing the actual elevation of the code reader;

means for comparing the actual elevation with the desired elevation;

means for applying a first control signal to said control means when the actual elevation is below the desired elevation, said control means responding to said first control signal to effect the first mode of said power means, thereby raising the platform and code reader; and means for applying a second control signal to said control means when the actual elevation is above the desired elevation, said control means responding to said second control signal to effect the second mode of said power means, thereby lowering the platform and code reader.

9. An elevator mechanism as set forth in claim 8, wherein said control means responds to the absence of both of said first and second control signals by deactivating said power means to maintain the platform and code reader stationary.

10. An elevator mechanism as set forth in claim 8, wherein said control means includes:

a first electric circuit operable when completed to effect the first mode of said power means;

a second electric circuit operable when completed to effect the second mode of said power means;

means for completing said first circuit and interrupting said second circuit when said first control signal is applied to said control means; and means for completing said second circuit and interrupting said first circuit when said second control signal is applied to said control means.

11. An elevator mechanism as set forth in claim 10, wherein said control means includes means for interrupting both of said first and second circuits when neither of said first and second control signals is applied to said control means.

12. An elevator mechanism as set forth in claim 7, including:

means for deactivating said power means when the platform and code reader have reached an upper limit of travel corresponding to a predetermined elevation; and means for deactivating said power means when the platform and code reader have reached a lower limit of travel corresponding to a lower predetermined elevation.

* * * * *